US006485583B1

(12) United States Patent
Vine et al.

(10) Patent No.: US 6,485,583 B1
(45) Date of Patent: Nov. 26, 2002

(54) ALUMINIUM-LITHIUM ALLOY

(75) Inventors: Wendy J Vine, Abingdon (GB); Andrew D Tarrant, Farnborough (GB)

(73) Assignee: Qinetiq Limited, London (GB)

( * ) Notice: Subject to any disclaimer, the term of this patent is extended or adjusted under 35 U.S.C. 154(b) by 0 days.

(21) Appl. No.: 09/762,763

(22) PCT Filed: Sep. 2, 1999

(86) PCT No.: PCT/GB99/02893

§ 371 (c)(1), (2), (4) Date: Feb. 13, 2001

(87) PCT Pub. No.: WO00/14291

PCT Pub. Date: Mar. 16, 2000

(30) Foreign Application Priority Data

Sep. 3, 1998 (GB) ..... 9819083

(51) Int. Cl.[7] ..... C22C 21/06; C22F 1/047

(52) U.S. Cl. ..... 148/440; 148/691; 420/542; 420/543

(58) Field of Search ..... 420/542, 543, 420/545, 547; 148/691, 440

(56) References Cited

U.S. PATENT DOCUMENTS 4,594,222 A 6/1986 Heck 4,600,556 A 7/1986 Donachie et al.

FOREIGN PATENT DOCUMENTS

| | | |
|---|---|---|
| EP | 0 180 144 | 5/1986 |
| EP | 0 194 700 | 9/1986 |

OTHER PUBLICATIONS

Styles et al, "Forging behaviour and properties of metal matrix composites based on mechanically alloyed Al–Mg–Li Alloy", Materials Science and Technology, vol. 14, Sep. 1998, pp. 913–919.

*Primary Examiner*—George Wyszomierski
*Assistant Examiner*—Janelle Combs-Morillo
(74) *Attorney, Agent, or Firm*—Nixon & Vanderhye P.C.

(57) ABSTRACT

A dispersion strengthened mechanically alloyed aluminium based alloy is provided which is prepared by mechanical alloying and is characterized by improved isotropic strength, fracture toughness and corrosion resistance. The alloy system contains by weight 1.2 to 1.6% lithium, 4.0 to 6.0% magnesium, 0.15 to 0.7% carbon, up to 1% oxygen and up to 2.0% in total of one or more grain controlling elements to provide microstructural optimization and control, the balance aluminium save for incidental impurities.

8 Claims, No Drawings

ALUMINIUM-LITHIUM ALLOY

This invention relates to high strength isotropic dispersion strengthened aluminium-lithium alloys and in particular to those alloys suitable for fabrication, via an mechanically alloying route, into forged, extruded or rolled products made therefrom.

In recent years considerable research efforts have been expended to develop high strength aluminium to satisfy the demands of advanced design in aircraft, automotive and electrical industries. Aluminium-lithium alloys are of interest in these fields because the addition of lithium offers the possibility of improving properties of aluminium with respect to density and elastic modulus. The level of addition of lithium is chosen to avoid precipitation of the δ' phase, $Al_3Li$ which would render the alloy heat treatable and so compromise its properties. Magnesium additions are also known to reduce the solubility of the lithium in the matrix and thus can render the alloy susceptible to age hardening. Magnesium has the further advantage of adding a component of solid solution strengthening. To meet the qualifications for certain advanced design applications, a combination of property requirements must be met including required density, strength, corrosion resistance, fracture toughness and ductility.

The use of a technique known as mechanical alloying to produce dispersioned strengthened powders has been well documented for example in UK Patent No. 1 265 432 and U.S. Pat. Nos. 3,591,362; 3,740,210 and 3,816,080. Mechanical alloying, as described in the aforesaid patents, is a method for producing uniform, finely dispersed, homogeneous metal powders by means of the fracturing and rewelding of a mixture of fine powders during high energy impact milling. Mechanically alloyed materials are characterised by a fine grain structure which is stabilised by uniformly distributed dispersoid particles such as carbides and/or oxides. For most uses, the powders produced by mechanical alloying are subsequently consolidated into bulk forms by, for example, degassing and then compacting the material. For fabrication into complex parts, this may be followed by extrusion, rolling or forging.

The problem with these techniques however, is that they are costly and time consuming; the handling and processing of a mechanically alloyed powder with conventional levels of carbon has associated health and safety problems; it can be difficult to balance the mechanical property requirements.

Aluminium-lithium-magnesium alloys manufactured by the abovementioned methods which have increased strength have been disclosed in EP 0 180 144. Heat treatable aluminium-lithium alloys which do not suffer from a reduction in strength as a result of the heat treatment process have been disclosed in EP 0 194 700. U.S. Pat. No. 4,600,556 discloses aluminium-lithium-magnesium alloys with improved strength and fracture toughness without an unacceptable loss in ductility. It has now been surprisingly found that high (4–6%) magnesium contents increase toughness and do not cause δ' phase precipitation provided the lithium content is less than 1.6%.

It is an objective of the invention to provide aluminium alloys with reduced health and safety problems as well as improved mechanical properties particularly isotropic strength and fracture toughness. The ultimate product forms of these materials are often complex shapes and it is a further object of the invention to provide aluminium alloys which can be manufactured and shaped using cost effective techniques, whilst retaining their desirable properties.

This present invention is directed towards the provision of a dispersioned strengthened aluminium based alloy having a composition within the following ranges, all of the ranges being specified in weight percent, comprising 1.2 to 1.6% lithium, 4.0 to 6.0% magnesium, 0.15 to 0.7% carbon, up to 1% oxygen, up to 2.0 in total of one or more further grain controlling elements and the balance, save for incidental impurities, aluminium.

The principle alloying elements are lithium and magnesium with further optional additions of up to 2.0% of one or more of the elements selected from those established in the art as suitable for microstructural optimisation and control. Preferably these further grain controlling elements are selected from scandium, titanium, vanadium and niobium at up to 0.2%, nickel and chromium at up to 0.5% and preferably at up to 0.2%, hafnium at up to 0.6% and cerium at up to 0.5%.

The carbon and oxygen in the alloy is generally provided by a process control agent added during the mechanical alloying process. In this alloy, according to the invention, the carbon level is lower than normally used for mechanically alloyed powders; but is sufficient to allow the production of the mechanically alloyed powder and has a number of advantages. The carbon and carbides in the system generally decorate the grain boundaries in the manufactured product, which consequently reduces the fracture toughness of the material. By reducing the level of carbon in the system, the inventors have determined that the amount present at grain boundaries is similarly reduced, resulting in a reduced presence of stress raisers. Crack propagation is therefore more difficult and fracture toughness is increased. The handling and processing of high levels of carbon in mechanically alloyed powders has associated health and safety problems which are reduced when less than 1% carbon is added. Further advantages of milled powders produced with low levels of carbon in accordance with the invention is that they are more coarse and therefore easier to handle. Another advantage of having a low level of carbon is that the milling time of the powder can be reduced. This is important as the mechanically alloying stage is time consuming and expensive.

In a preferred embodiment of the invention, the aluminium alloy contains by weight percent: 1.2 to 1.4% lithium; 4.5 to 5.5% magnesium; 0.25 to 0.35% carbon up to 1% oxygen. These levels of alloying additions give a good balance of properties. The properties of lithium and magnesium are such that the effects of solid solution strengthening produced by the magnesium addition are not significantly reduced by the level of lithium addition.

Alloys according to the invention are also found to exhibit improved isotropic tensile performance, fracture toughness and corrosion resistance.

In one route to fabrication, the alloy can be mechanically alloyed and the resulting powder degassed and compacted into billets. A person skilled in the art will realise that there are a number of different methods that can be employed to produce billets, hot isostatic pressing (HIP) is an example.

Billets can be fabricated into the ultimate product forms by extrusion, rolling, forging or other known methods. If complex parts are to be manufactured with little waste, a preferred manufacturing route to use is forging. Forging allows complex parts to be manufactured with near net shape resulting in very little material wastage and post manufacture working of the product is kept to a minimum. Two important parameters in the forging stage are forging temperature and the amount and type of reduction the billet encounters.

The forging temperature is critical to the metallurgical structure of the alloy. If the forging temperature is too high, the grains in the alloy grow which reduces the strength of the final product thus, the advantages gained in producing a mechanically alloyed powder are reduced. A number of factors influence the temperature that the alloy reaches during forging, including the temperature of the die, the temperature of the billet—before entering the die, the speed of forging, the amount of reduction in forging and the thickness of the final part. These factors influence not only the mechanical property differences in different parts but also within a part.

A preferred embodiment of the invention is characterised in that the alloy is forged at a temperature within the range 250 to 450 ° C. In a more preferred embodiment, the alloy billet is forged within the range 300 to 400° C.

The amount and type of reduction used in the forging stage affects both the temperature of the forging and the mechanical properties of the product. Shear stresses produced in the billet during forging cause the breakdown of oxide boundaries present on the powder particles of the mechanically alloyed material. By breaking down these oxide boundaries, the forging process disperses the oxides in the material so reducing the chance of large particles of oxides being present on the grain boundaries of the forged product. This in turn results in a product with improved mechanical properties. The amount and type of reduction used depends partly on the type of forging process used. In open die forging, a reduction ratio of greater than 8:1 is necessary to fully develop the ductility of the alloy. In die forging, where the work is more constrained, lower reduction ratios are sufficient.

The following table shows four alloys according to the present invention showing constituents and mechanical properties. For all properties except fracture toughness, the values given are an average taken from different testing directions. The fracture toughness results are from the T-L direction. The aluminium alloys were prepared using mechanically alloying. The powders were compacted and the resulting billets forged at 300° C.

TABLE 1

| COMPOSITION | UTS (MPa) | 0.2% Proof Stress (MPa) | Strain to Failure (%) | Fracture Toughness ($Mpam^{1/2}$) |
|---|---|---|---|---|
| 1.3% Li, 5.2% Mg, 0.35% C | 500.6 | 441.4 | 11.90 | 23.1 |
| 1.57% Li, 4.8% Mg, 0.25% C | 481.1 | 418.2 | 11.05 | 20.2 |
| 1.3% Li, 4.0% Mg, 0.45% C | 436.0 | 372.0 | 10.00 | 23.7 |
| 1.3% Li, 5.2% Mg, 0.25% C | 491.5 | 432.4 | 11.15 | 17.1 |

What is claimed is:

1. A method for the production of an aluminum-based alloy product comprising:

(1) preparing a mechanically alloyed powder having a composition within the following ranges, all of the ranges being specified in weight percent:

| | |
|---|---|
| lithium | 1.2 to 1.4 |
| magnesium | 4.5 to 5.5 |
| carbon | 0.25 to 0.40 |
| oxygen | up to 1.0 |

and optionally, up to 2.0 of grain controlling elements, said elements being selected from scandium, titanium, vanadium and niobium at up to 0.2 weight percent, nickel and chromium at up to 0.5 weight percent, hafnium at up to 0.6 weight percent, and cerium at up to 0.5 weight percent, the balance being aluminum and incidental impurities;

(2de-gassing and consolidating the powder at an elevated temperature, followed by (3) fabricating the de-gassed and consolidated powder into an ultimate product form of the same composition.

2. A method according to claim 1 wherein nickel and chromium are present at up to 0.2 weight percent.

3. A method according to claim 1 wherein the fabrication of the de-gassed and consolidated powder into the aluminum-based product is carried out using forging at a temperature of between 250 and 450° C.

4. A method according to claim 3 wherein the forging process is carried out at a temperature of 300 to 400° C.

5. An aluminum-based alloy product produced by the method of claim 1.

6. An aluminum-based alloy product produced by the method of claim 2.

7. An aluminum-based alloy product produced by the method of claim 3.

8. An aluminum-based alloy product produced by the method of claim 4.

* * * * *